United States Patent [19]

Fuller

[11] Patent Number: 4,765,269

[45] Date of Patent: Aug. 23, 1988

[54] RIGHTABLE CATAMARAN

[75] Inventor: D. Kirk Fuller, 31 Breakwater, Santa Barbara, Calif. 93109

[73] Assignees: D. Kirk Fuller; T. Felkay, both of Santa Barbara, Calif. ; part interest to each

[21] Appl. No.: 59,335

[22] Filed: Jun. 8, 1987

Related U.S. Application Data

[63] Continuation-in-part of Ser. No. 914,354, Oct. 2, 1986, abandoned.

[51] Int. Cl.[4] ..... B63B 1/00

[52] U.S. Cl. ..... 114/61; 114/39.1; 114/68; 114/123

[58] Field of Search ..... 114/39, 68, 69, 123, 114/125, 54

[56] References Cited

U.S. PATENT DOCUMENTS

| | | | |
|---|---|---|---|
| 2,918,030 | 12/1959 | Bagnall | 114/68 |
| 3,996,874 | 12/1976 | Winch | 114/39 |
| 4,117,795 | 10/1978 | Ruiz | 114/68 |

FOREIGN PATENT DOCUMENTS

| | | | |
|---|---|---|---|
| 2541648 | 8/1984 | France | 114/61 |

*Primary Examiner*—Sherman D. Basinger
*Assistant Examiner*—Jesûs D. Sotelo
*Attorney, Agent, or Firm*—William W. Haefliger

[57] ABSTRACT

A capsized catamaran having hollow pontoons, or pontoon sections, is righted by:

(i) employing and operating automatic flooding means for locally flooding the pontoons to effect rotation and sinking of ends of the pontoons, to cause the catamaran to up-end in the water, and (ii) removing water from the flooded pontoons to cause the catamaran to right itself in the water, from up-ended state.

21 Claims, 4 Drawing Sheets

FIG. 1.
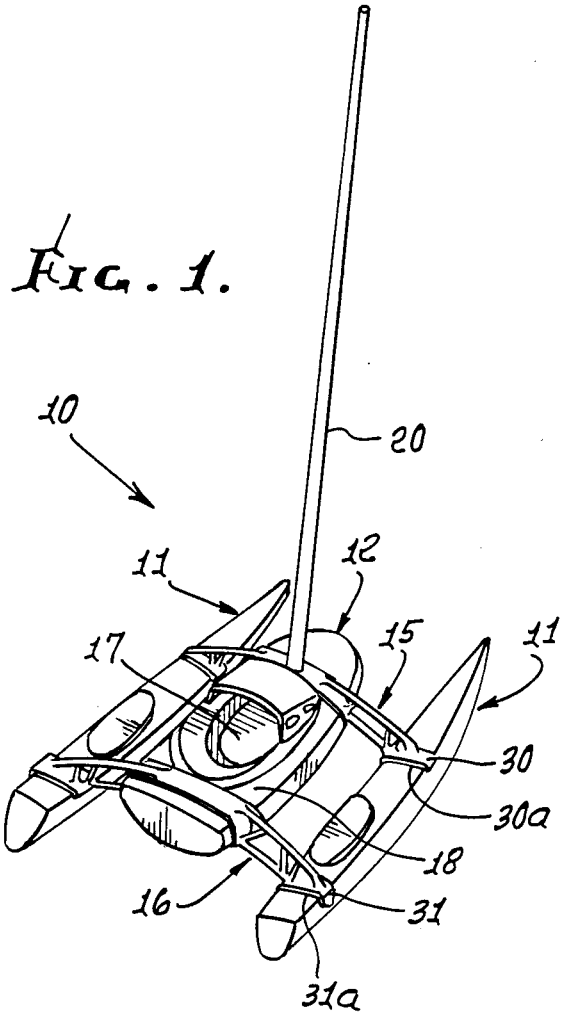
FIG. 3.
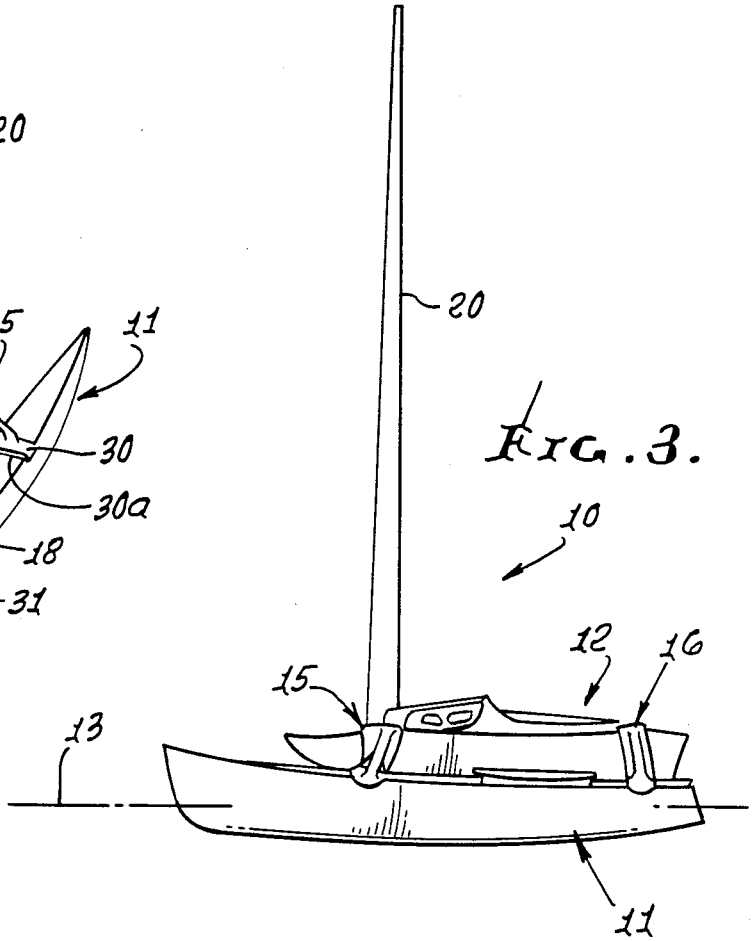
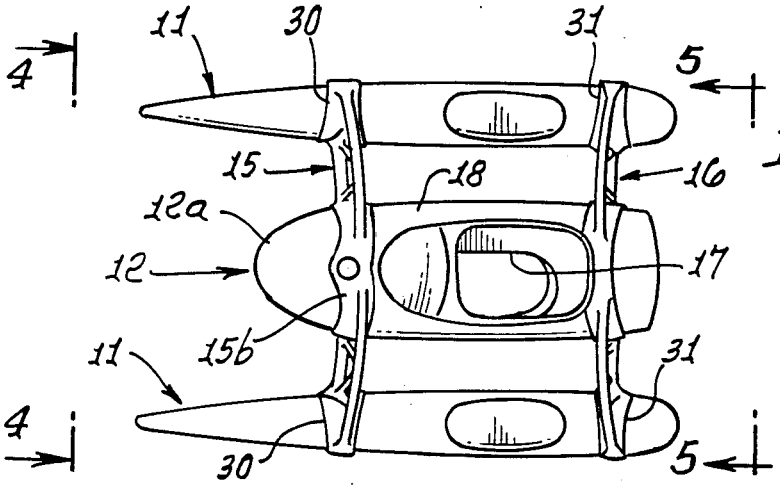
FIG. 2.

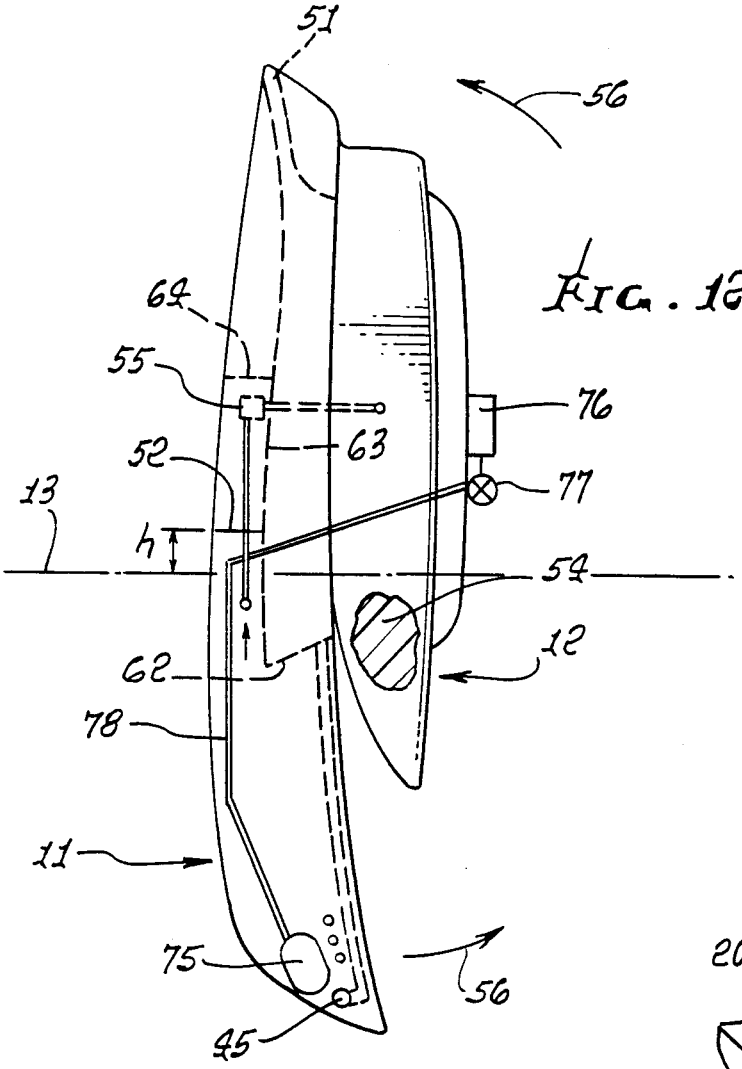
FIG. 12.
FIG. 13.
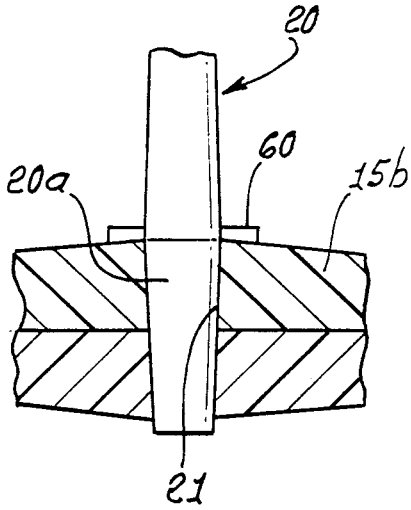
FIG. 14.
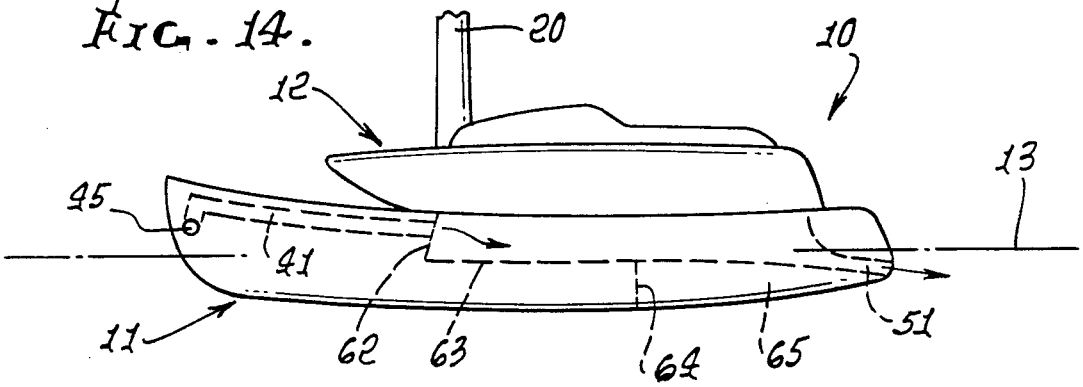

RIGHTABLE CATAMARAN

BACKGROUND OF THE INVENTION

This application is a continuation-in-part of Ser. No. 914,354, filed Oct. 2, 1986, now abandoned.

This invention relates generally to catamarans, and more particularly to improved catamaran structure enhancing safety, simplicity and reliability, and facilitating righting of a capsized catamaran.

When catamarans capsize, it is extremely difficult to right them due to their spaced pontoon construction. Accordingly, there is need for means to facilitate such righting for safety purposes; also, there is need for simplifications in catamaran construction, leading to reduce cost, demountability to street-legal width, and also facilitating assembly of pontoons to intermediate structure of catamaran. The above needs are critical in the case of ocean-going catamarans which must be of heavy duty, relatively large size construction.

SUMMARY OF THE INVENTION

It is a major object of the of the invention to provide an improved catamaran construction meeting the above needs, and also providing additional advantages, as will be seen. Basically, the improved structure comprises:

(a) two forwardly longitudinally elongated, laterally spaced pontoons adapted to float on a body of water, (b) a forwardly elongated pod, (c) and arched support means attached to the pontoons and supporting the pod in elevated relation to the pontoons and above the space between the pontoons.

As will be seen, each pontoon advantageously may have an end compartment, and conduit means to conduct water to said end compartments to flood same when the catamaran is capsized in inverted position, whereby the flooded end compartments of the pontoons then tend to sink in the water and the opposite ends of the pontoons tend to rise above water surface level, for rotating the catamaran into upright position. The end compartments may be at the forward ends of the pontoons, and said conduit means includes two conduits each having a forward inlet exposed to the pontoon exterior, and a rearward outlet exposed to the interior of said compartment.

Further, each conduit typically extends generally rearwardly, the outlets being located in the upper half of the conduit when the catamaran is upright, whereby water entering the inlets when the catamaran is upright flows in the conduits below the outlets to discharge outside said compartments, and water entering the inlets when the catamaran is inverted flows in the conduits to discharge via said outlets into said compartments. Also, each pontoon may include a self-bailing zone into which water drains from said conduit when the catamaran is upright.

It is a further object to provide arched support means that includes fore and aft arch structures which are longitudinally spaced apart, the arched structures having endwise telescoping interconnection with said pontoons. As will be seen the forward arch structure advantageously telescopically clamps relatively rearwardly onto the pontoons, and aft arch structure telescopically clamp relatively forwardly onto the pontoons. In this regard, each pontoon may have laterally projecting upper rails over which the arch structure clamps. Further, mast anchoring means of new-type may be provided.

Basically, then, the catamaran construction is characterized by:

(a) two pontoons, (b) means to support structure between the pontoons, and facilitating demountability, (c) and means to automatically and locally flood the pontoon interiors and discharge water from the flooded interiors in such manner as to rotate the catamaran from inverted to righted condition.

These and other objects and advantages of the invention, as well as the details of an illustrative embodiment, will be more fully understood from the following specification and drawings, in which:

DRAWING DESCRIPTION

FIG. 1 is a perspective view;

FIG. 2 is a top plan view;

FIG. 3 is a left side view;

FIG. 12 is a side elevation showing the catamaran nose down in the water, during end-over rotary righting of the capsized catamaran;

FIG. 13 is a side elevation showing retention of the mast to a socket in the catamaran pod; and FIG. 14 is an elevation showing the catamaran in righted position.

DETAILED DESCRIPTION

Figure 4:
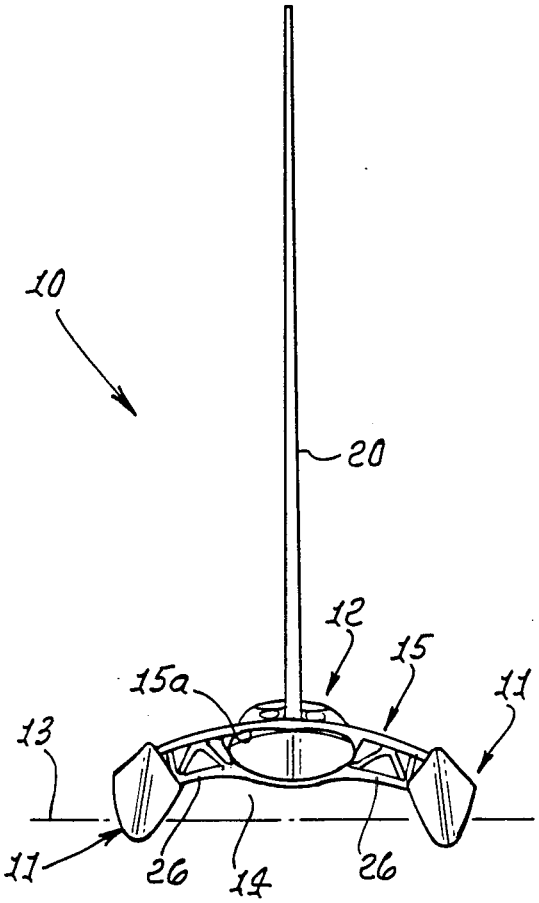
FIG. 4 is a front view on lines 4—4 of FIG. 2.
Figure 5:
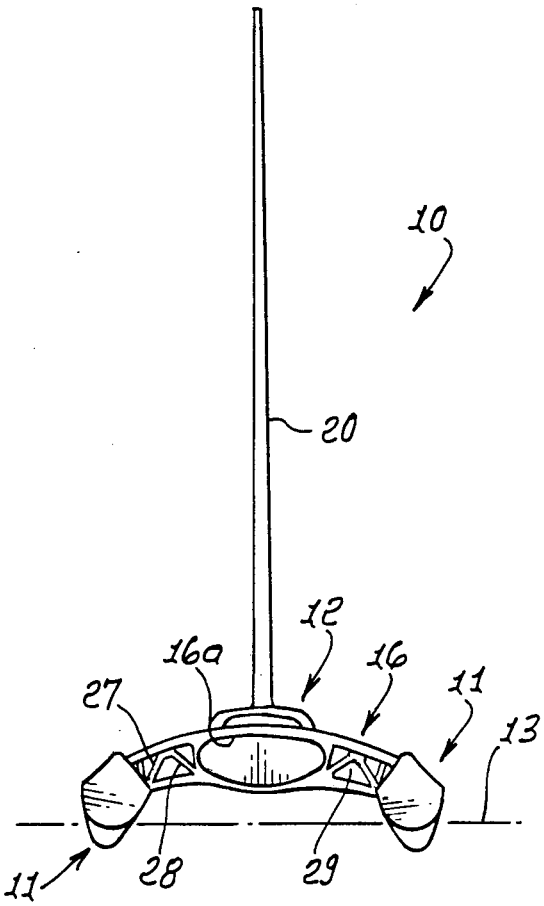
FIG. 5 is a rear view on lines 5—5 of FIG. 2.
Figure 6:
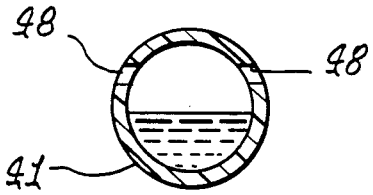
FIG. 6 is an enlarged view, in section, of a conduit in catamaran upright position.
Figure 7:
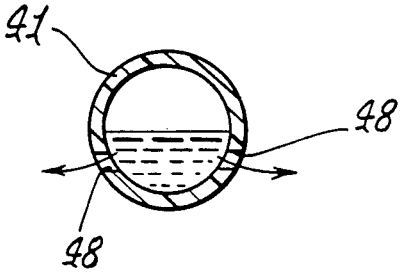
FIG. 7 is a view like FIG. 6, in catamaran inverted position.
Figure 9:
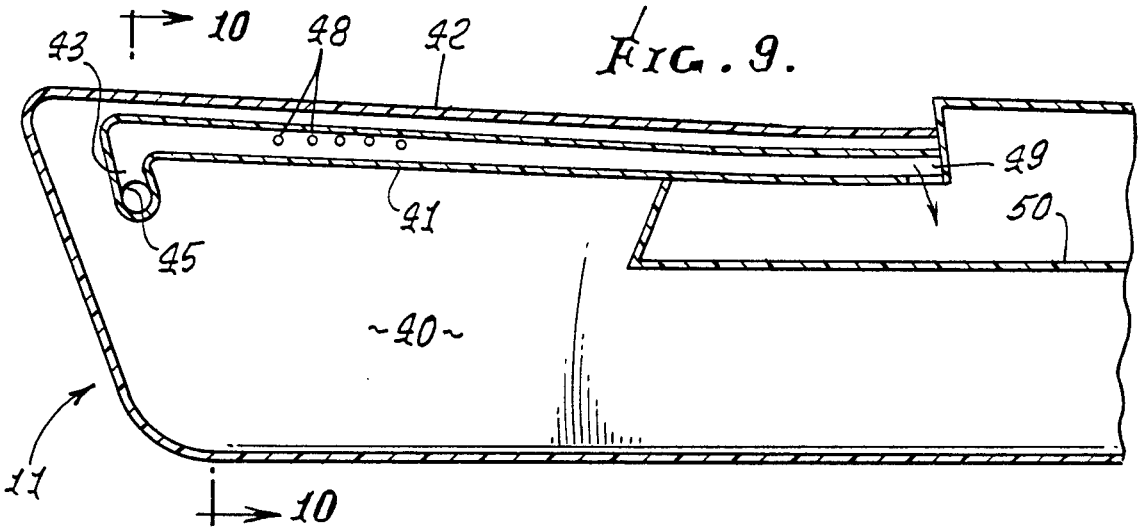
FIG. 9 is an enlarged side elevation showing a pontoon flooding conduit system.

In FIGS. 1-6, the improved catamaran 10 includes two forwardly elongated, laterally spaced pontoons 11 (alike) adapted to float on a body of water. A forwardly elongated pod 12 is supported by arched support structure in elevated position relative to the water level, indicated for example at 13, and above the space 14 between the pontoons. The arched support structure or means is shown in the example to include fore and aft arch structures 15 and 16, which are longitudinally spaced apart. As shown, the structures 15 and 16 form openings **15*a* and 16*a* endwise receiving fore and aft extensions of the pod, and fore and aft of a donward recess 17 below the upper deck 18. Recess 17 provides access to an interior compartment or compartments of the pod structure, forming a cabin or cabins. The pod is forwardly tapered at 12*a*; also forward arch mid-portion 15*b* that endwise receives the forwardly tapered extent 12*a* also downwardly receives the lower extend 20*a* of mast 20, the mid-portion forming a socket 21 to receive the mast (see FIG. 13). Mast lower end is tapered at 20*a*, to also fit in 15*b* and pin 60**, as shown.

The arched supports at 15 and 16 have structural cross brace construction at 26 with upright and laterally extending brace members 27 an 28, forming openings at 29 to pass sea-water. Thus, the arches form trusses, of great strength. Such structure may also consist of glass fiber material including sheets bonded together as by epoxy adhesive, cured in situ. It will further be noted that the openings 15*a* and 16*a* formed by the arched trusses' midportions telescopically receive endwise oppositely tapering end extents of the pod, enabling rapid assembly and disassembly of the pod and arches. The arches may be pinned, bolted, or otherwise attached to the pod.

Figure 8:
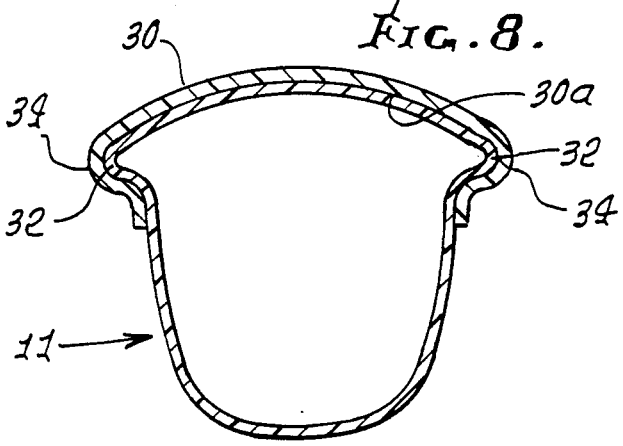
FIG. 8 is an enlarged section showing details of the clamp interfit of an arched support and a pontoon with rail means.
Figure 11:
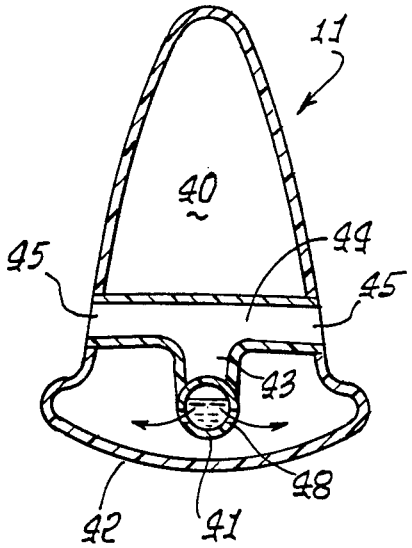
FIG. 11 is a section liked FIG. 10, but with the pontoon inverted in the water as during capsizing inversion of the catamaran.
Figure 10:
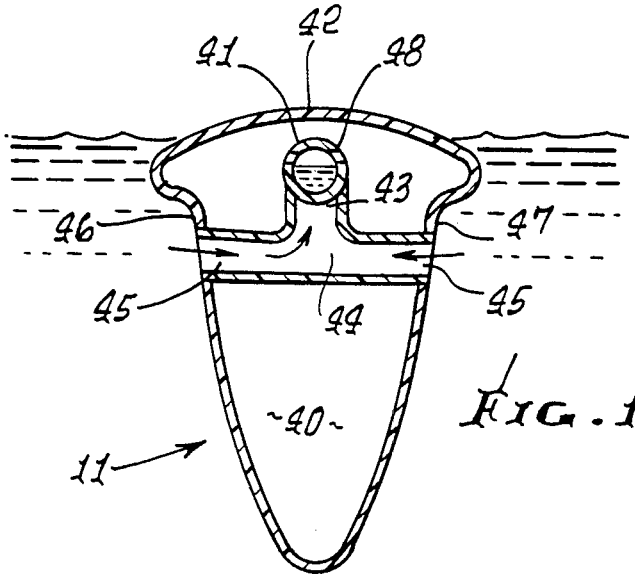
FIG. 10 is a section on lines 10—10 of FIG. 9 showing water entry access to the flooding system.

The arched structures 15 and 16 also have endwise telescopically interconnection with the pontoons 11. Thus, for example, the forward arched structure 15 has C-shaped clamps 30 forming downwardly opening receptacles 30*a* receiving the forwardly tapering upper extents of the pontoons; and the rearward arched truss structure 16 has C-shaped clamps 31 forming downwardly opening receptacles 31*a* receiving rearwardly tapering upper extents of the pontoons. The latter may advantageously form laterally oppositely projecting rails 32 closely receiving the clamp curved end portions 34 seen in FIG. 8. Thus, the arched structure can slide off the pontoons or hulls, for demounting purposes, and rapid telescopic endwise assembly and disassembly of the arches and pontoons is facilitated, whereby the catamaran may be easily separated into its components, for land transport. The pontoons also consist of glass fiber layers molded to shape and bonded as by epoxy resin. In FIG. 13, the mast may act as a pin to securely locate the cross arm 15 to pod 12.

Further in accordance with the invention, provision is made for ready righting of the catamaran after capsizing in the ocean or other body of water. To this end means is provide to controllably and locally flood the pontoon interiors and to discharge water from the flooded interiors, all in such manner and sequence that roll-over pitching, i.e. rotation, of the catamaran is effected, from inverted to righted condition.

Referring in this regard to FIGS. 6–12, each pontoon has an end compartment, as for example a forward compartment 40, in communication with conduit means generally indicated at 41. The conduit is shown to extend rearwardly just beneath the pontoon top deck 42, to communicate at 43 and 44 with lateral inlets 45 at the upper lateral sides 46 and 47 of the pontoon, beneath rails 32. The conduit also has outlets 48 along its length and in the upper facing side of the conduit, i.e. above the level of water draining through the conduit in FIGS. 6, 9 and 10 and toward the discharge end 49 of the conduit. That discharge end discharges to a self bailing deck 50, from which water drains laterally to the ocean, as via drain outlet 51 at the aft end of the pontoon (see FIG. 12). Note that water can enter the conduit via side inlets 45, in upright condition of the pontoons, as when ocean waves rise and break over the front end of the pontoon (see FIG. 10).

When the catamaran is capsized (see inverted pontoon of FIG. 11) the inlets 45 are below water level, and water can enter them to flow into the conduit 41, and to exit from the conduit via outlets 48 and into the compartment 40. As that compartment fills with water, in each pontoon, the pontoon fore and sinks until the catamaran is up-ended in the water, as viewed in FIG. 12. The water level in the hull of the pontoon reaches level 52, above outside water level by amount "h", as indicated. Foam floatation in the pod, at 54, prevents sinking of the catamaran, the nose of the pod projecting downwardly into the ocean. Once the bows sink to their maximum depths, as in FIG. 12, water is displaced in compartment 40 and at the bow tips by inflating bladers 75 or air holding devices, as by supplying compressed air to the bladders from a small high pressure air tank 76 (or compressor), and via control valve 77 and lines 78 to the bladders. This provides the buoyancy for the second half of the righting operation. The bladders are anchored in position at the forward ends of the bows. As air and water are displaced from compartment 40, the up-ended catamaran rotates in the direction of arrows 56, to right itself. Note that the floatation provided at 54 exerts a torque tending to rotate the catamaran in direction of arrows 56. Bilge pump 55 evacuates excess water from compartment 40 after righting is accomplished.

The compartment 40 is isolated from the deck area 50 by partitions 62–64. Note water tight rear compartments 65.

The present self-righting system involves no moving parts because gravity is employed to automatically determine whether water enters forward areas of the pontoons.

I claim:

1. A catamaran construction, comprising:

(a) two forwardly longitudinally elongated, laterally spaced pontoons adapted to float on a body of water, (b) a forwardly elongated pod, (c) and arched support means attached to the pontoons and supporting the pod in elevated relation to the pontoons and above space between the pontoons, (d) each pontoon having a floodable end compartment, and conduit means to conduct water to said end compartments to flood same when the catamaran is capsized in inverted position, whereby the flooded end compartments of the pontoons then tend to sink in the water, and the opposite ends of the pontoons tend to rise above water surface level, for rotating the catamaran into upright position, (e) and including inflatable bladder means in said floodable end compartments to displace water therefrom when the pontoons are in upright positions.

2. The catamaran construction of claim 1 wherein said compartments are at the forward ends of the pontoons, and said conduit means includes two conduits each having a forward inlet exposed to the pontoon exterior, and a rearward outlet exposed to the interior of said compartment.

3. The catamaran construction of claim 2 wherein each conduit extends generally rearwardly, said outlets located in the upper half of each conduit when the catamaran is upright, whereby water entering the inlets when the catamaran is upright flows in the conduits below said outlets to discharge outside said compartments, and water entering the inlets when the catamaran is inverted flows in the conduits to discharge via said outlets into said compartments.

4. The catamaran of claim 3 wherein each pontoon also includes a self bailing zone into which water drains from said conduits when the catamaran is upright.

5. The catamaran of claim 4 wherein said end compartments extend longitudinally beneath said self bailing zones.

6. The catamaran of claim 4 wherein said end compartments are at the forward ends of the pontoons, there also being water-tight rear compartments extending below the self bailing zones.

7. The catamaran construction of claim 1 wherein said arched support means includes fore and aft arch structures which are longitudinally spaced apart.

8. The catamaran construction of claim 7 wherein the arch structures have endwise telescoping interconnection with said pontoons.

9. The catamaran construction of claim 8 wherein the fore arch structure telescopically clamp relatively rearwardly onto the pontoons, and the aft arch structures telescopically clamp relatively forwardly onto the pontoons.

10. The catamaran construction of claim 9 wherein each pontoon has laterally projecting upper rail means over which the arch structures clamp.

11. The catamaran construction of claim 10 wherein each arch structure has C-shaped receptacles fitting over the upper extents of the pontoons and said rail means.

12. The catamaran structure of claim 1 including a mast attached to said pod, the arched support means forming openings receiving the rod.

13. The catamaran structure of claim 12 wherein the mast has a base portion received in an upright socket defined by the pod, proximate the arched support means, the mast base portion tapering downwardly to seat in the socket.

14. The catamaran structure of claim 13 wherein the pod and each pontoon consists of molded glass fiber and resin layers.

15. The catamaran structure of claim 14 wherein the pod is hollow and forms an elevated cabin.

16. The catamaran construction of claim 1 wherein the pod has a forward flotation section positioned to project into the ocean and exert righting torque on the catamaran when the flooded end compartments of the pontoons project downwardly into the water.

17. A catamaran comprising (a) two pontoons, (b) means to support structure between the pontoons, (c) and means including inflatable bladders in the pontoons to controllably and locally flood the pontoon interiors and discharge water from the flooded interiors in such manner as the rotate the catamaran from inverted to righted condition, said bladders located to displace water from the pontoon interiors when the bladders are inflated and when the pontoons are in upright positions.

18. The method of righting a capsized catamaran having hollow pontoons containing inflatable bladders, that includes:

(i) employing and operating automatic flooding means for locally flooding the pontoons to effect rotation and sinking of ends of the pontoons, to cause the catamaran to up-end in the water, and (ii) removing water from the flooded pontoons by inflating the bladders to cause the catamaran to right itself in the water, from up-ended state.

19. The method of claim 18 wherein the catamaran includes a pod generally between the pontoons, and including the step of causing the pod to partially enter the water in up-ended state of the catamaran to exert floatation force creating a torque tending to right the catamaran.

20. A catamaran construction, comprising:

(a) two forwardly longitudinally elongated, laterally spaced pontoons adapted to float on a body of water, (b) a forwardly elongated pod, (c) and arched support means attached to the pontoons and supporting the pod in elevated relation to the pontoons and above space between the pontoons, (d) said arched support means including forward and aft arch structures which are longitudinally spaced apart, the forward arch structure telescopically clamping relatively rearwardly onto the pontoons, and the aft arch structure telescopically clamping relatively forwardly onto the pontoons, the pontoons tapering forwardly from the forward arch structure, and tapering rearwardly from the aft arch structure, (e) and including a mast attached to said pod, the arched structure forming openings receiving the pod, the mast associated with the forward arch structure.

21. The catamaran structure of claim 20 wherein the mast has a base portion received in an upright socket defined by the pod, proximate the forward arch structure, the mast base portion tapering downwardly to seat in the socket.

* * * * *